US007665476B2

(12) United States Patent
Lisciandro et al.

(10) Patent No.: US 7,665,476 B2
(45) **Date of Patent: *Feb. 23, 2010**

(54) ASYMMETRIC UMBRELLA

(75) Inventors: Donna Lisciandro, New York, NY (US); Hyuk Hur, Long Island City, NY (US); Jane DeNavi, Long Island City, NY (US)

(73) Assignee: Dry Rain, LLC, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/052,498

(22) Filed: Mar. 20, 2008

(65) Prior Publication Data

US 2008/0163911 A1 Jul. 10, 2008

Related U.S. Application Data

(63) Continuation of application No. 10/977,290, filed on Oct. 29, 2004, now Pat. No. 7,350,530.

(51) Int. Cl.
*A45B 11/00* (2006.01)
*A45B 23/00* (2006.01)
*A45B 19/10* (2006.01)

(52) U.S. Cl. ..... 135/20.1; 135/25.3; 135/25.31

(58) Field of Classification Search ..... 135/20.1
See application file for complete search history.

(56) References Cited

U.S. PATENT DOCUMENTS

| | | | |
|---|---|---|---|
| 1,053,337 | A | 2/1913 | Williams |
| 2,707,476 | A | 5/1955 | Clemens |
| 2,948,289 | A | 8/1960 | Owczarek |
| 3,042,055 | A | 7/1962 | Todorovic |
| 4,474,200 | A | 10/1984 | Kida |
| 4,474,201 | A | 10/1984 | Kida |
| 5,263,505 | A | 11/1993 | Yeom |
| 5,505,221 | A | 4/1996 | Gao |
| D419,759 | S | 2/2000 | Goudarzi |
| D437,109 | S | 2/2001 | Muscella |
| 6,196,244 | B1 | 3/2001 | Haddad et al. |
| 2006/0070644 | A1 | 4/2006 | Schneller |

FOREIGN PATENT DOCUMENTS

| | | |
|---|---|---|
| CN | 86208964AU | 8/1987 |
| CN | 2030425 U | 1/1989 |
| CN | 2181826 Y | 11/1994 |
| DE | 20 2005 014 161 U1 | 5/2006 |
| JP | 03-063003 | 3/1991 |
| JP | 2003-174910 | 6/2003 |
| UA | U200503830 | 4/2007 |
| WO | 2005/084479 A1 | 9/2005 |

*Primary Examiner*—David Dunn
*Assistant Examiner*—Danielle Jackson
(74) *Attorney, Agent, or Firm*—Fish & Richardson P.C.

(57) ABSTRACT

An asymmetric umbrella includes a canopy, a shaft eccentrically disposed beneath the canopy, and a runner slidably mounted on the shaft and slidable between a first position, in which the canopy is collapsed, and a second position in which the canopy is extended. A canopy supporting frame includes rib assemblies each of which has a first end coupled to an apex of the shaft and a second end coupled to the canopy, wherein each of the rib assemblies further comprises a short rib assembly and a long rib assembly.

59 Claims, 5 Drawing Sheets

ASYMMETRIC UMBRELLA

CROSS-REFERENCE TO RELATED APPLICATION(S)

This application claims is a continuation of U.S. patent application Ser. No. 10/977,290, filed on Oct. 29, 2004.

BACKGROUND OF THE INVENTION

1. Field of the Invention

The present invention relates to umbrellas. More specifically, the present invention relates to an asymmetric umbrella having an off-center shaft.

2. Description of the Prior Art

Umbrellas conventionally comprise of a center shaft from which a plurality of ribs of equal length are pivotally attached. The ribs extend radially outwards forming a symmetrical frame supporting a canopy. The disadvantage of a conventional umbrella having a center shaft is that it divides the canopy space, forcing the user to be displaced to the perimeter of the canopy. Due to this displacement, conventional umbrellas provide inadequate shelter, exposing the users' side and back to the elements. Moreover, the unused canopy space, particularly of larger umbrellas, makes walking difficult on busy sidewalks.

Asymmetrical umbrellas are known. Asymmetrical umbrellas provide an off-center shaft, thereby allowing the user to stand beneath the center of the umbrella canopy, thereby providing greater protection from the elements. For example, U.S. Pat. Nos. 4,474,201 and 4,474,200 to Kida disclose umbrellas having an oval canopy and an asymmetrically disposed shaft. However, the asymmetrical umbrellas disclosed by the Kida references have a canopy that is functionally inferior to conventional umbrella canopies. Specifically, the Kida umbrella canopies are loosely and unsightly bunched about the frame when the frame is in the closed position. Patent WO9944458, to Goudarzi discloses an asymmetrical umbrella having ribs of equal length when the umbrella is in the folded position. The Goudarzi design is functionally inferior to conventional umbrellas because when the umbrella is in the folded position several of the distal ribs of the long main ribs fold upwards in an inverted fold, while several short main ribs point downwards. The inverted fold is structurally weak and is inadequate to fully extend the umbrella canopy when in the open position. Moreover, when the umbrella of Goudarzi is in the closed position, the upwardly folding long distal ribs are exposed. The exposed upwardly folding long distal ribs are unsightly and are subject to damage.

U.S. Pat. No. 5,505,221 to Gao discloses an asymmetrical umbrella having telescoping deployment arms of varying lengths. The Gao umbrella is also inferior to conventional umbrellas. Telescoping deployment arms weaken the overall structure of the umbrella, as telescoping components are easily subject to bending and breaking, thereby rendering the umbrella inoperable. Moreover, the umbrella of Gao has distal ribs of graded length to offset the shaft and maintain a circular canopy shape when opened. Thus, when the Gao umbrella is in the closed position, the distal ribs terminate unevenly, resulting in an awkward appearance.

Asymmetrical umbrellas known in the art have been awkward in usability and stowage. The disadvantages are most evident when the umbrellas are closed, displaying uneven distal rib lengths, some of which point up as well as down, or telescoping and slidable ribs which are not only costly to construct and easily broken, but create unsightly bunching of the canopy.

Thus, a need exists for an improved asymmetric umbrella having distal ends that point in the same direction when the canopy is collapsed. A need further exists for an asymmetric umbrella having rib assemblies of substantially uniform length when the canopy is collapsed.

SUMMARY OF THE INVENTION

It is an object of the present invention to provide an asymmetric umbrella.

It is another object of the present invention to provide an asymmetric umbrella comprising: a canopy; a shaft eccentrically disposed beneath said canopy; a runner slidably mounted on said shaft and slidable between a first position.

It is yet another object of the present invention to provide an asymmetric umbrella wherein the distal ends of each of said rib assemblies points in the same direction when said canopy is collapsed.

It is a further object of the present invention to provide an asymmetric umbrella wherein the plurality of rib assemblies are of substantially uniform length when said canopy is collapsed.

It is a still further object of the present invention to provide an asymmetrical umbrella that is collapsed and extended as easily and uniformly as conventional compact umbrellas.

These and other objects, and advantages of the present invention are achieved by an asymmetric umbrella comprising: a canopy; a shaft eccentrically disposed beneath said canopy; a runner slidably mounted on said shaft and slidable between a first position, wherein said canopy is collapsed, and a second position, wherein said canopy is extended; and a plurality of rib assemblies forming a canopy supporting frame, each of said rib assemblies being coupled to the apex of said shaft at a proximal end and fixed to said canopy and at a distal end, wherein the distal ends of each of said rib assemblies points in the same direction when said canopy is collapsed, and wherein said plurality of rib assemblies are of substantially uniform length when said canopy is collapsed.

BRIEF DESCRIPTION OF THE DRAWINGS

The above and other objects, advantages and benefits of the present invention will be understood by reference to the detailed description provided below and the accompanying drawings.

DESCRIPTION OF THE PREFERRED EMBODIMENTS

Figure 1:
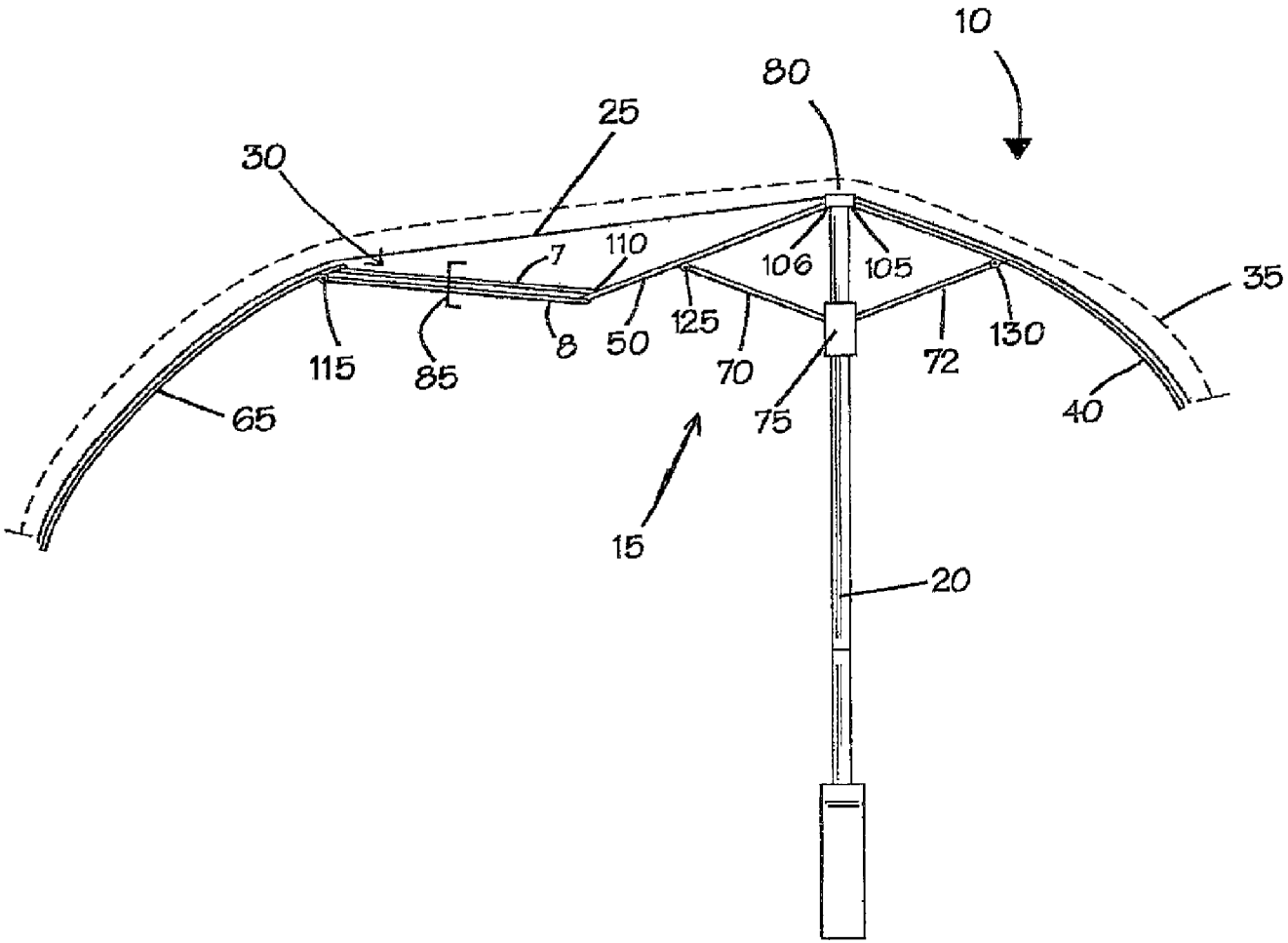
FIG. 1 is a sectional view of a first embodiment of the asymmetric umbrella of the present invention.

Referring to the drawings, and in particular to FIG. 1, there is provided a first embodiment of an asymmetrical umbrella according to the present invention generally represented by numeral 10. Umbrella 10 includes a shaft 20, a slidable runner 75, a canopy 25, and a canopy support frame 15. Shaft 20 is preferably disposed eccentrically beneath canopy 25. Slidable runner 75 is movably mounted on shaft 20 and is slidable between a first position, wherein said canopy is collapsed, as illustrated in FIG. 3A, and a second position, wherein said canopy is extended, as illustrated in FIGS. 2C, 3B and 3C.

Referring again to FIG. 1, support frame 15 comprises a plurality of rib assemblies. Support frame 15 preferably has at least one short main rib assembly 35 and at least one long main rib assembly 30. Each of short main rib assembly 35 and long main rib assembly 30 is coupled to the apex 80 of shaft 20 at a proximal end and fixed to canopy 25 at a distal end. In a preferred embodiment, support frame 15 has four short main rib assemblies 35 and four long main rib assemblies 30. More preferably, at least two of long main rib assemblies 30 are greater than twice the length of short main ribs 35. Short main rib assemblies 35 and long main rib assemblies 30 act to raise canopy 25 to the extended position in a smooth and continuous motion and to lower canopy 25 to the collapsed position in a smooth and continuous motion. Any coupling means known in the art may be employed, however it is preferable that all couplings of short main rib assemblies 35 and long main rib assemblies 30 are pivotal couplings, thereby enabling smooth function of support frame 15.

Figure 3A:
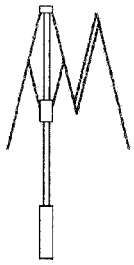
FIG. 3A is a sectional view of a first embodiment of the asymmetric umbrella illustrated in FIG. 1 in the collapsed position.
Figure 3B:
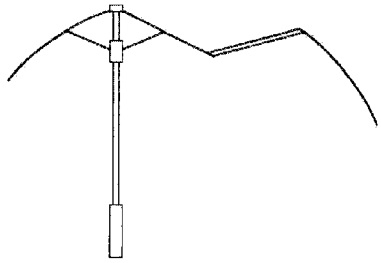
FIG. 3B is a sectional view of a first embodiment of the asymmetric umbrella illustrated in FIG. 1 in the extended position.
Figure 3C:
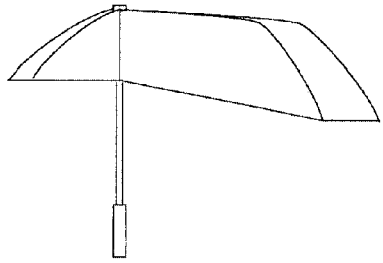
FIG. 3C is a side perspective view of a first embodiment of the asymmetric umbrella illustrated in FIG. 1 in the extended position.
Figure 4A:
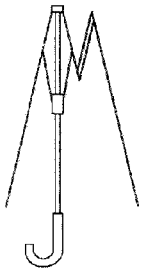
FIG. 4A is a sectional view of a second embodiment of the asymmetric umbrella of the present invention in the collapsed position.

As illustrated in FIGS. 3*a* and 4*a*, the distal ends of each of short main rib assemblies 35 and long main rib assemblies 30 point in the same direction when canopy 25 is in the collapsed position. Preferably, the distal ends of each of the short main rib assemblies 35 and long main rib assemblies 30 point in the downward direction when canopy 25 is collapsed. More preferably, the distal ends of each of short main rib assemblies 35 and long main rib assemblies 30 are of substantially uniform length when canopy 25 is in the collapsed position, thereby maintaining the look of a conventional umbrella.

Figure 2A:
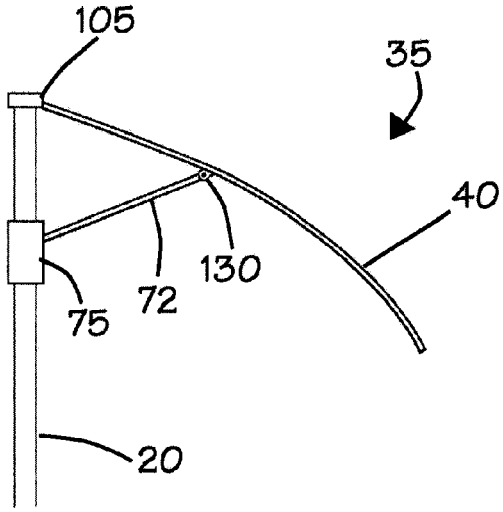
FIG. 2A is a sectional view of the short main rib of a first embodiment of the asymmetric umbrella of the present invention illustrated in FIG. 1.

Referring to FIGS. 1 and 2A, short main rib assembly 35 has a deployment arm 72 and a proximal rib 40. Deployment arm 72 is coupled to runner 75 on a first end thereof and to proximal rib 40 on a second end thereof. Proximal rib 40 is coupled to the apex 80 of shaft 20 at a joint 105 and to deployment arm 72 by any suitable means known in the art. Proximal rib 40 is fixedly attached to canopy 25. Joint 105 is preferably a pivotal connection. Short main rib assembly 35 may optionally have a distal short rib 45 (not shown) connected to proximal rib 40. Any coupling means known in the art may be employed, however it is preferable that all couplings of short main rib assemblies 35 and long main rib assemblies 30 are pivotal couplings.

Figure 2B:
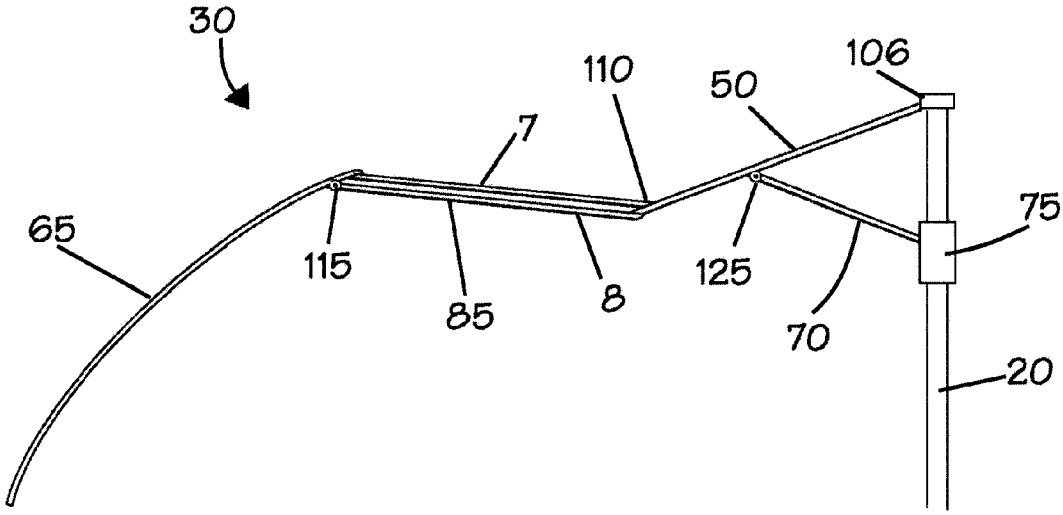
FIG. 2B is a sectional view of the long main rib of a first embodiment of the asymmetric umbrella of the present invention illustrated in FIG. 1.
Figure 2C:
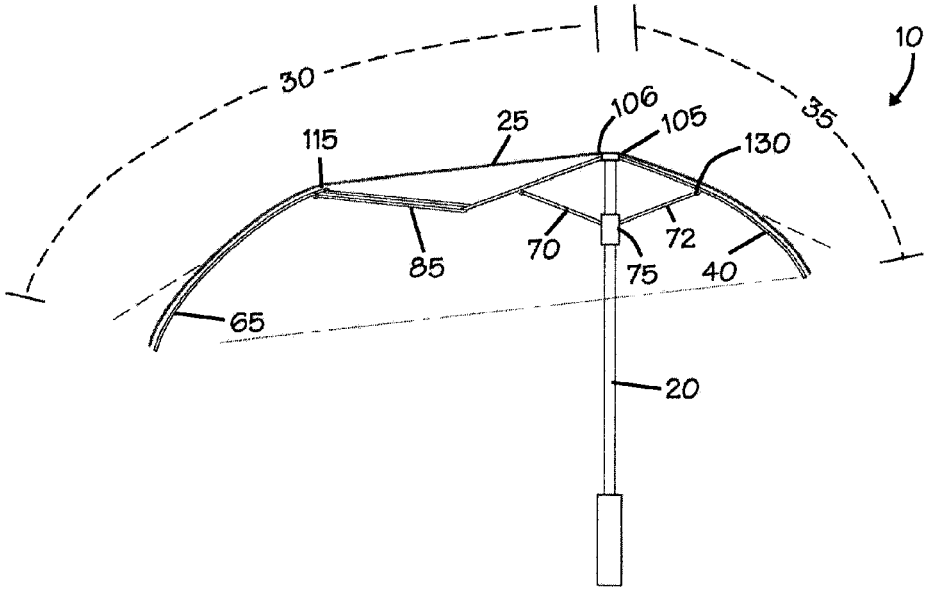
FIG. 2C is a sectional view illustrating the angled canopy of the asymmetrical umbrella of FIG. 1.
Figure 2D:
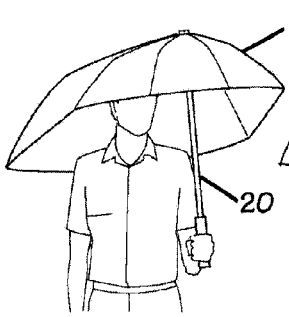
FIG. 2D is a front perspective view of the asymmetric umbrella of FIG. 1.
Figure 2E:
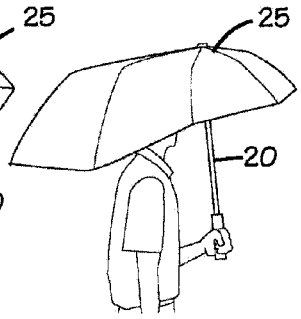
FIG. 2E is a side perspective view of the asymmetric umbrella of FIG. 1.
Figure 2F:
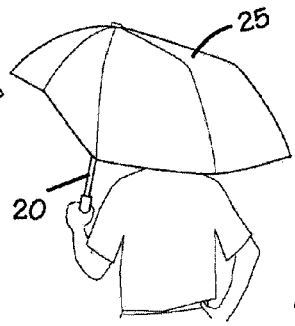
FIG. 2F is a rear perspective view of the asymmetric umbrella of FIG. 1.
Figure 2G:
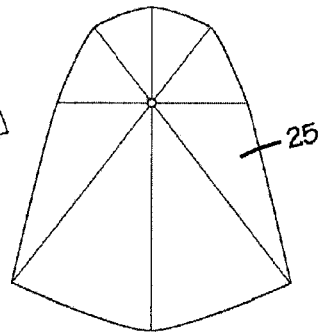
FIG. 2G is a top elevational view of the asymmetric umbrella of FIG. 1.

Referring to FIGS. 1 and 2B, long main rib assembly 30 has a deployment arm 70, a proximal rib 50, a hinge joint 85, and a distal rib 65. Deployment arm 70 is coupled to slidable runner 75 and to proximal rib 50. Proximal rib 50 is coupled to the apex 80 of shaft 20 at a joint 106 and to hinge joint 85 at a joint 110. Hinge joint 85 is coupled to proximal rib 50 and to distal rib 65. Hinge joint 85 is coupled to distal rib 65 at a joint 115. Distal rib 65 is fixedly attached to canopy 25. Hinge joint 85 is preferably a quadrilateral hinge joint having a connecting arm 8 and a support rib 7. Connecting arm 8 is preferably disposed in parallel relation to support rib 7. Any coupling means known in the art may be employed, however it is preferable that all couplings of short main rib assemblies 35 and long main rib assemblies 30 are pivotal couplings.

An elongate canopy 25 may be provided by employing a support frame 15 configuration having a long main assembly 30, wherein proximal rib 50, connecting arm 8 and support rib 7 are shorter in length than distal rib 65.

Deployment arms 70 and 72 are preferably of equal length. Deployment arm 70 is preferably pivotally connected to proximal rib 50 to form a joint 125. Joint 125 is preferably a pivotal connection and is preferably disposed along proximal rib 50 at a mid-point thereof. Deployment arm 72 is preferably pivotally connected to proximal rib 40 to form a joint 130. Joint 130 is preferably a pivotal connection and is preferably disposed along proximal rib 40 at a mid-point thereof. Joints 125 and 130 are preferably symmetrically positioned to form equal triangular deployment hinges between proximal rib 50 and deployment arm 70 and proximal rib 35 and deployment arm 72.

The distance between joints 105 and 130 is preferably less than half of the distance between joint 106 and joint 115. Thus, shaft 20 is disposed beneath canopy 25 at a position that is greater than one-half of the length of canopy 25 at its widest point. More preferably, shaft 20 is disposed beneath canopy 25 at a position that is greater than two-thirds of the length of the canopy at its widest point. As illustrated in FIGS. 2D, 2E, 2F and 2G, offset shaft 20 allows a user to be positioned directly beneath the center of canopy 25, thereby providing more even canopy coverage and improved protection from the elements. Additionally, the increased space of canopy 25 between joints 106 and 115 acts to ease tension between the tip of proximal rib 40 and joint 115 when umbrella 10 is extended and collapsed. Accordingly, smooth folding movement between extended and collapsed positions of canopy 25 is achieved.

Referring to FIG. 2C, canopy 25 aids the flexion of short main rib assemblies 35 and long main rib assemblies 30, thereby increasing the angle of canopy 25 off the horizontal plane when umbrella 10 is in the extended position. Canopy 25 actively flexes the distal ends of short main rib assemblies 35 and long main rib assemblies 30 to increase the elevation of canopy 25 off the horizontal plane when canopy 25 is extended. Flexion of the distal ends of short main rib assemblies 35 and long main rib assemblies 30 is preferably about 20.degree. from their normal position. The angle formed by canopy 25 and the horizontal plane is preferably about 8.degree. The angle formed by canopy 25 and the horizontal plane provides greater protection from the elements to the user.

Figure 4B:
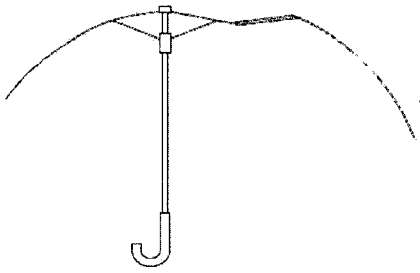
FIG. 4B is a sectional view of a second embodiment of the asymmetric umbrella of the present invention in the extended position.
Figure 4C:
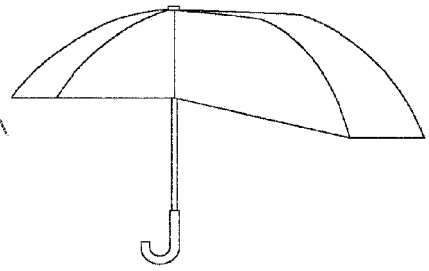
FIG. 4C is a side perspective view of a second embodiment of the asymmetric umbrella of the present invention in the extended position.

It should be noted that an umbrella that is similar in appearance to a traditional cane umbrella, as illustrated in FIGS. 4A, 4B and 4C, may be provided by adding extensions to distal ribs 65 and proximal ribs 40.

Figure 5A:
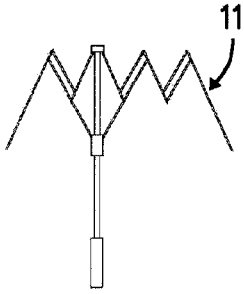
FIG. 5A is a sectional view of a third embodiment of the asymmetric umbrella of the present invention in the collapsed position.
Figure 5B:
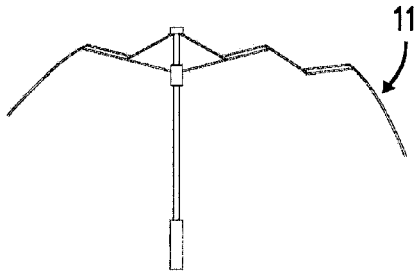
FIG. 5B is a sectional view of a third embodiment of the asymmetric umbrella of the present invention in the extended position.
Figure 5C:
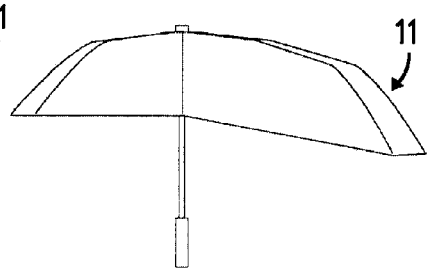
FIG. 5C is a side perspective view of a third embodiment of the asymmetric umbrella of the present invention in the extended position.
Figure 6:
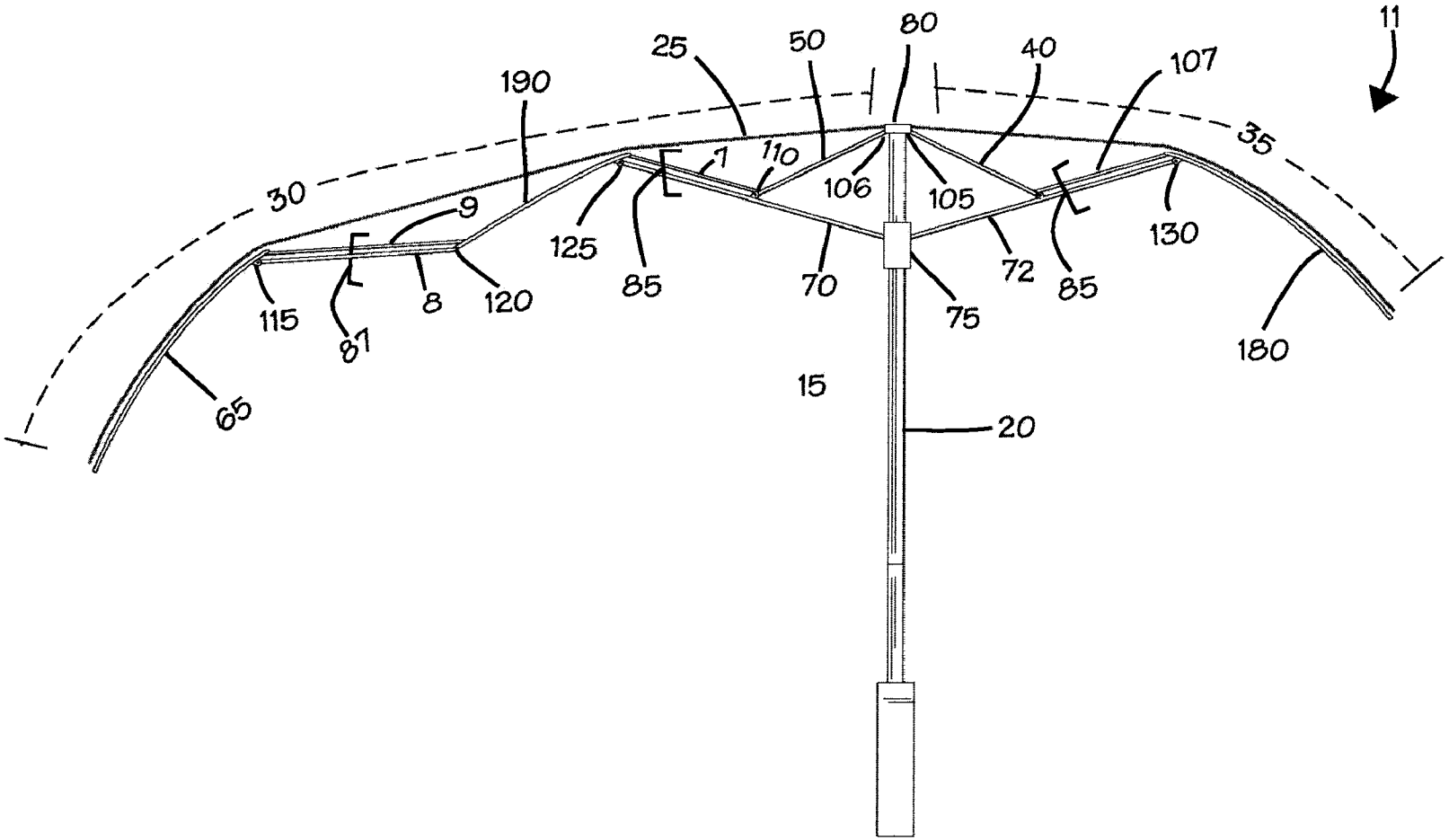
FIG. 6 is a sectional view of the third embodiment of the asymmetric umbrella of the present invention in the extended position.

An alternate embodiment of the present invention represented by reference numeral 11 in FIGS. 5A, 5B, 5C and 6 provides an umbrella having a full-sized canopy that is substantially more compact when in the collapsed position. Referring to FIG. 6, umbrella 11, similar in structure and function to the first described embodiment, includes a shaft 20, a slidable runner 75, a canopy 25, and a canopy support frame 15. Shaft 20 is preferably disposed eccentrically beneath canopy 25. Slidable runner 75 is movably mounted on shaft 20 and is slidable between a first position, wherein said canopy is collapsed, as illustrated in FIG. 5A, and a second position, wherein said canopy is extended, as illustrated in FIGS. 5B and 5C.

Similar to the first described embodiment, umbrella 11 has a support frame 15, which comprises a plurality of rib assemblies. Support frame 15 preferably has at least one short main rib assembly 35 and at least one long main rib assembly 30. Each of short main rib assembly 35 and long main rib assembly 30 is coupled to the apex 80 of shaft 20 at a proximal end and fixed to canopy 25 at a distal end.

As illustrated in FIG. 5*a*, the distal ends of each of short main rib assemblies 35 and long main rib assemblies 30 point in the same direction when canopy 25 is in the collapsed position, as in the above-described embodiment. Preferably, the distal ends of each of the short main rib assemblies 35 and long main rib assemblies 30 point in the downward direction when canopy 25 is collapsed. More preferably, the distal ends of each of short main rib assemblies 35 and long main rib assemblies 30 are of substantially uniform length when canopy 25 is in the collapsed position, thereby maintaining the look of a conventional umbrella.

The more compact canopy support frame 15 of umbrella 11 provides a two-rib configuration for each short main rib assembly 35 and a four-rib configuration for each long main rib assembly 30. All ribs of umbrella 11 are proportionately shorter than the ribs of the above-described embodiment, while deployment arms 70 and 72 are proportionately longer than the ribs of the above-described embodiment.

Referring again to FIG. 6, short main rib assembly 35 has a deployment arm 72, a proximal rib 40, a support rib 7 and a distal rib 180. Deployment arm 72 is coupled to runner 75 on a first end thereof and to distal rib 180 at a distal end thereof. Proximal rib 40 is coupled to the apex 80 of shaft 20 at a joint 105, to deployment arm 72 at approximately a mid-point thereof, and to support rib 107. Support rib 107 extends along a portion of and parallel to deployment arm 72. Support rib 107 and deployment arm 72 are coupled at their distal ends to distal rib 180. Support rib 107 and deployment arm 72 form a hinge joint 85. Hinge joint 85 is preferably a quadrilateral hinge joint. Distal rib 180 is fixedly attached to canopy 25. Any coupling means known in the art may be employed, however it is preferable that all couplings of short main rib assemblies 35 and long main rib assemblies 30 are pivotal couplings.

Long main rib assembly 30 has a deployment arm 70, a proximal rib 50, a first hinge joint 85, a shortened distal rib 190, a second hinge joint 87 and a distal rib 65. Deployment arm 70 is coupled to slidable runner 75 at a first end thereof and to shortened distal rib 190 at a distal end thereof. Proximal rib 50 is coupled to the apex 80 of shaft 20 at a joint 106, to deployment arm 70 at approximately a mid-point thereof, and to a support rib 7 at a joint 110. Support rib 7 extends along a portion of and parallel to deployment arm 70. Support rib 7 and deployment arm 70 are coupled at their distal ends to the proximal end of shortened distal rib 190, forming a joint 125. Support rib 7 and deployment arm 70 form hinge joint 85. Hinge joint 85 is preferably a quadrilateral hinge joint. Shortened distal rib 190 is coupled at its distal end to second hinge joint 87, forming a joint 120. Hinge joint 87 is preferably a quadrilateral hinge joint having a connecting arm 8 and a second support rib 9. Connecting arm 8 is preferably disposed in parallel relation to second support rib 9. Distal rib 65 is coupled at a proximal end thereof to second hinge joint 87, forming joint 115. Distal rib 65 is fixedly attached to canopy 25. Any coupling means known in the art may be employed, however it is preferable that all couplings of short main rib assemblies 35 and long main rib assemblies 30 are pivotal couplings.

To ensure that shaft 20 is disposed greater than two-thirds across the length of canopy 25 at its widest point, the length of distal rib 65 is shortened by approximately one third. Connecting arm 8 and second support rib 9 of second hinge joint 87 are likewise shortened to approximately the length of distal rib 65.

In a preferred embodiment of the present invention, distal rib 65 and distal rib 180 are preferably formed of a material that is lighter in weight than the material of the remaining ribs of canopy support frame 15. The lightweight material of distal rib 65 and distal rib 180 provides greater flexibility to canopy support frame 15.

All embodiments of the present invention may employ manual or automatic unfolding mechanisms.

The present invention having been thus described with particular reference to the preferred forms thereof, it will be obvious that various changes and modifications may be made therein without departing from the spirit and scope of the present invention as defined in the appended claims.

What is claimed is:

1. An asymmetric umbrella comprising:

a canopy;

a shaft eccentrically disposed beneath the canopy;

a runner slidably mounted on the shaft and slidable between a first position, wherein the canopy is collapsed, and a second position, wherein the canopy is extended; and a plurality of rib assemblies forming a canopy supporting frame, each of the rib assemblies being coupled to the apex of the shaft at a proximal end and fixed to the canopy at a distal end, the plurality of rib assemblies further comprising:

a short main rib assembly having a deployment arm, a first rib, and a second rib, wherein the deployment arm is coupled to the runner, the first rib, and the second rib, the first rib is coupled to the shaft apex and the deployment arm, and the second rib is coupled to a first peripheral point of the canopy; and a long main rib assembly having a deployment arm, a first rib, a second rib, a connecting arm, and a third rib, wherein the deployment arm is coupled to the runner, the first rib, and the second rib; the first rib is coupled to the shaft apex and the deployment arm; the second rib is coupled to the deployment arm and the connecting arm; and the third rib is coupled to the connecting arm and a second peripheral point of the canopy, wherein the distal end of each of the rib assemblies points in the same direction when the canopy is collapsed.

2. The asymmetric umbrella of claim 1 wherein the plurality of rib assemblies are of substantially uniform length when the canopy is collapsed.

3. The asymmetric umbrella of claim 1 wherein the deployment arm of the short main rib assembly and the deployment arm of the long main rib assembly are of substantially equal length.

4. The asymmetric umbrella of claim 1 wherein a support rib is disposed substantially parallel to the deployment arm of the long main rib assembly.

5. The asymmetric umbrella of claim 1 wherein a support rib is disposed substantially parallel to the deployment arm of the short main rib assembly.

6. The asymmetric umbrella of claim 1 wherein a support rib is disposed substantially parallel to the second rib of the long main rib assembly.

7. The asymmetric umbrella of claim 1 wherein a support rib is disposed substantially parallel to the connecting arm of the long main rib assembly.

8. The asymmetric umbrella of claim 1 wherein the shaft is attached to a point on the canopy that is located at a distance from a peripheral point of the canopy that is greater than one-half of the width of the canopy at its widest span.

9. The asymmetric umbrella of claim 1 wherein the shaft is attached to a point on the canopy that is located at a distance from a peripheral point of the canopy that is greater than two-thirds of the width of the canopy at its widest span.

10. The asymmetric umbrella of claim 1 wherein the long main rib assembly is at least twice the length of the short main rib assembly when the canopy is extended.

11. The asymmetric umbrella of claim 1 wherein the short main rib assembly deployment arm and the short main rib assembly first rib form a short main rib assembly triangular hinge joint with the shaft; wherein the long main rib assembly deployment arm and the long main rib assembly first rib form a long main rib assembly triangular hinge joint with the shaft; and wherein the short main rib assembly triangular hinge joint and the long main rib assembly triangular hinge joint have substantially equal angles and proportions.

12. The asymmetric umbrella of claim 1 wherein the first rib of the short main rib assembly is attached to a point substantially at the center of the deployment arm of the short main rib assembly, and the first rib of the long main rib assembly is attached to a point substantially at the center of the deployment arm of the long main rib assembly.

13. An asymmetric umbrella comprising:

a canopy;

a shaft eccentrically disposed beneath the canopy;

a runner slidably mounted on the shaft and slidable between a first position, in which the canopy is collapsed, and a second position, in which the canopy is extended; and a canopy supporting frame comprising rib assemblies each of which has a first end coupled to an apex of the shaft and a second end coupled to the canopy, wherein each of the rib assemblies further comprise:

a short rib assembly comprising a deployment arm and a rib, wherein the deployment arm is coupled at one end to the runner and at a second end to the rib, and wherein the rib is coupled at one end to the apex of the shaft and at a second end to a peripheral point of the canopy; and a long rib assembly comprising a deployment arm, a first rib, a second rib, and a third rib, wherein the deployment arm is coupled at one end to the runner and at a second end to the first rib, wherein the first rib is coupled at one end to the apex of the shaft and at a second end to the second rib, wherein the second rib is coupled at one end to the first rib and at a second end to the third rib, and wherein the third rib is coupled at one end to the second rib, wherein the shaft is attached to a point on the canopy that is located at a distance from a peripheral point of the canopy that is greater than two-thirds of the width of the canopy at its widest span.

14. The asymmetric umbrella of claim 13 wherein the third rib of the long rib assembly is coupled at a second end to a peripheral point of the canopy.

15. The asymmetric umbrella of claim 13 wherein the ends of each of the rib assemblies point in the same direction when the canopy is collapsed.

16. The asymmetric umbrella of claim 13 wherein the rib assemblies are of substantially uniform length when the canopy is collapsed.

17. The asymmetric umbrella of claim 13 wherein the deployment arm of the short rib assembly and the deployment arm of the long rib assembly are of substantially equal length.

18. The asymmetric umbrella of claim 13 wherein the long rib assembly is at least twice the length of the short rib assembly when the canopy is extended.

19. The asymmetric umbrella of claim 13 wherein a support rib is disposed substantially parallel to the second rib of the long rib assembly.

20. The asymmetric umbrella of claim 13 wherein the deployment arm of the short rib assembly and the rib of the short rib assembly form a first triangular hinge joint with the shaft; wherein the deployment arm of the long rib assembly and the first rib of the long rib assembly form a second triangular hinge joint with the shaft; and wherein the first and second triangular hinge joints have substantially equal angles and proportions.

21. The asymmetric umbrella of claim 13 wherein the deployment arm of the short rib assembly is attached to a point substantially at the center of the rib of the short rib assembly, and the deployment arm of the long rib assembly is attached to a point substantially at the center of the first rib of the long rib assembly.

22. An asymmetric umbrella comprising:

a canopy;

a shaft eccentrically disposed beneath the canopy;

a runner slidably mounted on the shaft and slidable between a first position, wherein the canopy is collapsed, and a second position, wherein the canopy is extended; and a canopy support frame comprising rib assemblies each of which has a first end coupled to an apex of the shaft and a second end coupled to the canopy, wherein the rib assemblies further comprise:

a short rib assembly having a deployment arm, a first rib, and a second rib, wherein the deployment arm is coupled at one end to the runner and at a second end to the second rib, wherein the first rib is coupled at one end to the apex of the shaft and at a second end to the deployment arm, and wherein the second rib is coupled at one end to the deployment arm; and a long rib assembly having a deployment arm, a first rib, a second rib, a third rib, and a fourth rib, wherein the deployment arm is coupled at one end to the runner and at a second end to the second rib, wherein the first rib is coupled at one end to the apex of the shaft and at a second end to the deployment arm, wherein the second rib is coupled at one end to the deployment arm and at a second end to the third rib, wherein the third rib is coupled at one end to the second rib and at a second end to the fourth rib, and wherein the fourth rib is coupled at one end to the third rib, wherein the long rib assembly is at least twice the length of the short rib assembly when the canopy is extended.

23. The asymmetric umbrella of claim 22 wherein the second rib of the short rib assembly is coupled at a second end to a peripheral point of the canopy.

24. The asymmetric umbrella of claim 22 wherein the fourth rib of the long rib assembly is coupled at a second end to a peripheral point of the canopy.

25. The asymmetric umbrella of claim 22 wherein the ends of each of the rib assemblies point in the same direction when the canopy is collapsed.

26. The asymmetric umbrella of claim 22 wherein the rib assemblies are of substantially uniform length when the canopy is collapsed.

27. The asymmetric umbrella of claim 22 wherein the deployment arm of the short rib assembly and the deployment arm of the long rib assembly are of substantially equal length.

28. The asymmetric umbrella of claim 22 wherein the shaft is attached to a point on the canopy that is located at a distance from a peripheral point of the canopy that is greater than one-half of the width of the canopy at its widest span.

29. The asymmetric umbrella of claim 22 wherein the shaft is attached to a point on the canopy that is located at a distance from a peripheral point of the canopy that is greater than two-thirds of the width of the canopy at its widest span.

30. The asymmetric umbrella of claim 22 wherein a support rib is disposed substantially parallel to the deployment arm of the short rib assembly.

31. The asymmetric umbrella of claim 22 wherein a support rib is disposed substantially parallel to the deployment arm of the long rib assembly.

32. The asymmetric umbrella of claim 22 wherein a support rib is disposed substantially parallel to the second rib of the long rib assembly.

33. The asymmetric umbrella of claim 22 wherein a support rib is disposed substantially parallel to the third rib of the long rib assembly.

34. The asymmetric umbrella of claim 22 wherein the deployment arm of the short rib assembly and the first rib of the short rib assembly form a first triangular hinge joint with the shaft; wherein the deployment arm of the long rib assembly and the first rib of the long rib assembly form a second triangular hinge joint with the shaft; and wherein the first and second triangular hinge joints have substantially equal angles and proportions.

35. The asymmetric umbrella of claim 22 wherein the first rib of the short rib assembly is attached to a point substantially at the center of the deployment arm of the short rib assembly, and the first rib of the long rib assembly is attached to a point substantially at the center of the deployment arm of the long rib assembly.

36. An asymmetric umbrella comprising:

a canopy;

a shaft eccentrically disposed beneath the canopy;

a runner slidably mounted on the shaft and slidable between a first position, wherein the canopy is collapsed, and a second position, wherein the canopy is extended; and a plurality of rib assemblies forming a canopy supporting frame, each of the rib assemblies being coupled to the apex of the shaft at a proximal end and fixed to the canopy at a distal end thereof, wherein the distal end of each of the rib assemblies points in the same direction when the canopy is collapsed, the plurality of rib assemblies further comprising:

a short main rib assembly having a deployment arm, a first rib, and a second rib, wherein the deployment arm is coupled to the runner, the first rib, and the second rib, the first rib is coupled to the shaft apex at a first end thereof and to the deployment arm at a joint located at an intermediate point of the deployment arm, the second rib is coupled to the deployment arm at a second joint located at a distal end of the deployment arm; and a long main rib assembly having a deployment arm, a first rib, a second rib, a connecting arm, and a third rib, wherein the deployment arm is coupled to the runner, the first rib, and the second rib; the first rib is coupled to the shaft apex and the deployment arm; the second rib is coupled to the deployment arm and the connecting arm; and the third rib is coupled to the connecting arm, wherein the deployment arm of the long main rib assembly is coupled to the runner at a first pivot joint and includes exactly two pivot joints along the entire length of the deployment arm.

37. An asymmetric umbrella comprising:

a canopy;

a shaft eccentrically disposed beneath the canopy;

a runner slidably mounted on the shaft and slidable between a first position, wherein the canopy is collapsed, and a second position, wherein the canopy is extended; and a plurality of rib assemblies forming a canopy supporting frame, each of the rib assemblies being coupled to the apex of the shaft at a proximal end and fixed to the canopy at a distal end, wherein the distal end of each of the rib assemblies points in the same direction when the canopy is collapsed, the plurality of rib assemblies further comprising:

a short main rib assembly having a deployment arm, a first rib, and a second rib, wherein the deployment arm is coupled to the runner, the first rib, and the second rib, the first rib is coupled to the shaft apex at a first end thereof and to the deployment arm at a joint located at an intermediate point of the deployment arm, the second rib being coupled to the deployment arm at a second joint located at a distal end of the deployment arm; and a long main rib assembly having a deployment arm, a first rib, a second rib, a connecting arm, and a third rib, wherein the deployment arm is coupled to the runner, the first rib, and the second rib; the first rib being coupled to the shaft apex and the deployment arm at a joint located at an intermediate point of the deployment arm; the second rib being coupled to the connecting arm and to a distal end of the deployment arm; and the third rib being coupled to the connecting arm, wherein the shod main rib assembly has a different construction, including a different number of joints, and a different number of components relative to the long main rib assembly.

38. An asymmetric umbrella comprising:

a canopy;

a shaft eccentrically disposed beneath the canopy;

a runner slidably mounted on the shaft and slidable between a first position, wherein the canopy is collapsed, and a second position, wherein the canopy is extended; and a plurality of rib assemblies forming a canopy supporting frame, each of the rib assemblies being coupled to the apex of the shaft at a proximal end and coupled to the canopy at a distal end, wherein the distal end of each of the plurality of rib assemblies points in the same direction when the canopy is collapsed, the plurality of rib assemblies further comprising:

a short main rib assembly having a deployment arm, a first rib, a hinge joint and a second rib, wherein the deployment arm is coupled to the runner and to the first rib; the first rib is coupled to the shaft apex, the deployment arm and the hinge joint; the hinge joint is coupled to the first rib and to the said second rib; and the second rib is coupled to a first peripheral point of the canopy;

a long main rib assembly having a deployment arm, a first rib, hinge joint, a second rib, a third rib, and a fourth rib, wherein the deployment arm is coupled to the runner, the first rib, and the second rib; the first rib is coupled to the shaft apex, the deployment arm, and the hinge joint; the hinge joint is coupled to the first rib and the second rib; the second rib is coupled to the hinge joint, the deployment arm and the third rib; the third rib is coupled to the second rib and the fourth rib; and the fourth rib is coupled to a second peripheral point of the canopy; wherein the short main rib assembly has a different construction, including a different number of joints, and a different number of components relative to the long main rib assembly.

39. The asymmetric umbrella of claim 38, wherein the deployment arm of the short rib assembly and the deployment arm of the long rib assembly are of substantially equal length.

40. The asymmetric umbrella of claim 38, wherein the hinge joint comprises a support rib disposed substantially parallel to the deployment arm to form a quadrilateral hinge joint.

41. The asymmetric umbrella of claim 38, wherein the hinge joint comprises four pivot joints.

42. The asymmetric umbrella of claim 38, wherein the shaft is attached to a point on the canopy that Is located at a distance from a peripheral point of the canopy that is greater than one-half of the width of the canopy at its widest span.

43. The asymmetric umbrella of claim 38, wherein the shaft is attached to a point on the canopy that is located at a distance from a peripheral point of the canopy that is greater than two-thirds of the width of the canopy at its.widest span.

44. The asymmetric umbrella of claim 38, wherein the plurality of rib assemblies are of substantially uniform length when the canopy is collapsed.

45. An asymmetric umbrella comprising:

a canopy;

a shaft eccentrically disposed beneath the canopy;

a runner slidably mounted on the shaft and slidable between a first position, wherein the canopy is collapsed, and a second position, wherein the canopy is extended; and a plurality of rib assemblies forming a canopy supporting frame, each of the rib assemblies being coupled to the apex of the shaft at a proximal end and coupled to the canopy at a distal end, wherein the distal end of each of the plurality of rib assemblies points in the same direction when the canopy is collapsed, the plurality of rib assemblies further comprising:

a short main rib assembly having a deployment arm and a rib, wherein the deployment arm is coupled to the runner and to the rib, and the rib is coupled to the shaft apex and to the deployment arm; and a long main rib assembly having a deployment arm, a proximal rib, a hinge joint, and a distal rib, wherein the deployment arm is coupled to the runner and to the proximal rib; the proximal rib is coupled to the shaft apex and the hinge joint; and the hinge joint is coupled to the proximal rib and to the distal rib, wherein the long main rib assembly proximal rib includes exactly four pivot joints along the entire length of the proximal rib.

46. The asymmetric umbrella of claim 45, wherein the deployment arm of the short rib assembly and the deployment arm of the long rib assembly are of substantially equal length.

47. The asymmetric umbrella of claim 45, wherein the hinge joint comprises a support rib disposed substantially parallel to the deployment arm to form a quadrilateral hinge joint.

48. The asymmetric umbrella of claim 45, wherein the hinge joint comprises four pivot joints.

49. The asymmetric umbrella of claim 45, wherein the shaft Is attached to a point on the canopy that is located at a distance from a peripheral point of the canopy that is greater than one-half of the width of the canopy at its widest span.

50. The asymmetric umbrella of claim 45, wherein the shaft is attached to a point on the canopy that is located at a distance from a peripheral point of the canopy that is greater than two-thirds of the width of the canopy at its widest span.

51. The asymmetric umbrella of claim 45, wherein the long main rib assembly is at least twice the length of the short main rib assembly when the canopy is extended.

52. The asymmetric umbrella of claim 45, wherein the plurality of rib assemblies are of substantially uniform length when the canopy Is collapsed.

53. An asymmetric umbrella comprising:

a canopy;

a shaft eccentrically disposed beneath the canopy;

a runner slidably mounted on the shaft and slidable between a first position, wherein the canopy is collapsed, and a second position, wherein the canopy is extended; and a plurality of rib assemblies forming a canopy supporting frame, each of the rib assemblies being coupled to the apex of the shaft at a proximal end and coupled to the canopy at a distal end, wherein the distal end of each of the plurality of rib assemblies points in the same direction when the canopy is collapsed, the plurality of rib assemblies further comprising:

a short main rib assembly having a deployment arm and a first rib, wherein the deployment arm is coupled to the runner and the first rib; and the first rib is coupled to the shaft apex and the deployment arm; and a long main rib assembly having a deployment arm, a first rib, a quadrilateral hinge joint, and a second rib, wherein the deployment arm is coupled to the runner and the first rib; the first rib is coupled to the shaft apex and the deployment arm; and the quadrilateral hinge joint is coupled to the first rib and the second rib, wherein the short main rib assembly has a different construction, including a different number of joints, and a different number of components relative to the long main rib assembly, and wherein the distal end of the long main rib assembly is on a lower plane than the distal end of the short main rib assembly when the canopy is extended and when the shaft is positioned perpendicular to the ground such that the apex of the shaft is pointed upwards, wherein the plane is parallel to the ground.

54. The asymmetric umbrella of claim 53, wherein the quadrilateral hinge joint comprises a support rib disposed substantially parallel to the deployment arm.

55. The asymmetric umbrella of claim 53, wherein the quadrilateral hinge joint comprises four pivot joints.

56. The asymmetric umbrella of claim 53, wherein the shaft is attached to a point on the canopy that is located at a distance from a peripheral point of the canopy that is greater than one-half of the width of the canopy at its widest span.

57. The asymmetric umbrella of claim 53, wherein the shaft is attached to a point on the canopy that is located at a distance from a peripheral point of the canopy that is greater than two-thirds of the width of the canopy at its widest span.

58. The asymmetric umbrella of claim 53, wherein the long main rib assembly is at least twice the length of the short main rib assembly when the canopy is extended.

59. The asymmetric umbrella of claim 53, wherein the plurality of rib assemblies are of substantially uniform length when the canopy is collapsed.

* * * * *

UNITED STATES PATENT AND TRADEMARK OFFICE

CERTIFICATE OF CORRECTION

PATENT NO. : 7,665,476 B2
APPLICATION NO. : 12/052498
DATED : February 23, 2010
INVENTOR(S) : Donna Lisciandro It is certified that error appears in the above-identified patent and that said Letters Patent is hereby corrected as shown below:

Column 1
Line 7 after "application" delete "claims".

Column 7
Line 64 after "wherein" delete "each of".

Column 10
Line 64 delete "shod" and insert -- short --.

Column 11
Line 20 after "to the" delete "said".

Column 11
Line 23 before "hinge" insert -- a --.

Column 11
Line 46 delete "Is" and insert -- is --.

Column 11
Line 52 delete "its. Widest" and insert -- its widest --.

Column 12
Line 26 delete "Is" and insert -- is --.

Column 12
Line 39 delete "Is" and insert -- is --.

Signed and Sealed this

Tenth Day of August, 2010

David J. Kappos

David J. Kappos
*Director of the United States Patent and Trademark Office*